United States Patent [19]

Williams, Jr.

[11] 4,255,472

[45] Mar. 10, 1981

[54] METERED FINISH

[75] Inventor: Louis B. Williams, Jr., Walnut Hill, Fla.

[73] Assignee: Monsanto Company, St. Louis, Mo.

[21] Appl. No.: 54,384

[22] Filed: Jul. 2, 1979

[51] Int. Cl.[3] ..... B05D 1/00

[52] U.S. Cl. ..... 427/445; 8/151.2; 8/158; 118/411; 118/401; 118/412; 118/420; 118/DIG. 19

[58] Field of Search ..... 427/445; 118/420, 411, 118/412, 401, DIG. 19; 8/151.2, 158

[56] References Cited

U.S. PATENT DOCUMENTS 3,827,397 8/1974 Hebberling ..... 118/420

*Primary Examiner*—Ronald H. Smith
*Assistant Examiner*—Janyce A. Bell
*Attorney, Agent, or Firm*—Kelly O. Corley

[57] ABSTRACT

In application of metered finish to a high speed running yarn, a vent is provided in the finish passageway just prior to the exit.

5 Claims, 5 Drawing Figures

METERED FINISH

The invention relates to the art of metering finish onto a yarn running at high speed.

An essential part of spinning a man-made yarn is application to the yarn of a finish, which is a liquid composition for lubrication, reduction of static electricity, and other functions. Non-uniform application of the finish along the length of the yarn creates various processing problems in subsequent operations of the yarn, and causes defects in products made from the yarn. Finish has commonly been applied by contacting the running yarn with the periphery of a slowly rotating wheel, the lower portion of the wheel being immersed in the finish. This method gives somewhat erratic results.

More recently, attempts have been made to meter the finish to an applicator (commonly known as a "finish pin") in order to improve uniformity of finish application. However when yarn speeds are above 2500 meter per minute, erratic results are frequently obtained when using known commercially available applicators. Applicant has discovered that much of the difficulty arises because of the influence of the turbulent, high speed air entrained with the rapidly running yarn.

According to a principal aspect of the invention, there is provided in a process for applying finish to a yarn running at least 2500 meters per minute and wherein finish is metered through a passageway just prior to application to the the yarn, the improvement comprising interrupting siphoning at the exit of the passageway. Preferably this is done by introduction of a gas into the passageway in the immediate vicinity of the exit.

According to another aspect of the invention, there is provided in a finish applicator having a finish passageway extending therethrough to an exit end, the improvement comprising means for interrupting siphoning at the exit end. The means is preferably a gas passageway communicating with the finish passageway in the immediate vicinity of the exit end. It is preferred that the gas passageway communicate with the atmopshere.

Other aspects will in part appear hereinafter and will in part be obvious from the following detailed disclosure taken in connection with the accompanying drawings, wherein.

Figure 1:
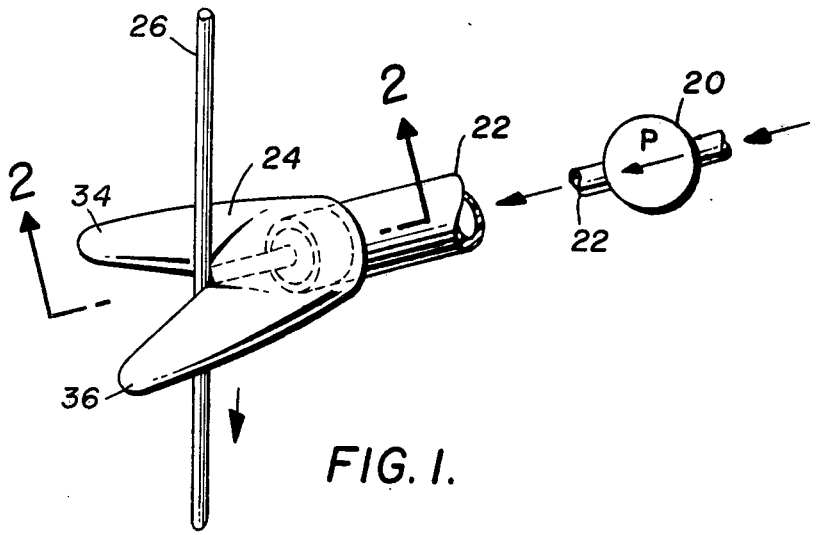
FIG. 1 is a schematic perspective view of a finish metering system.

FIG. 1 schematically shows the general metered finish system. As illustrated, finish is metered at a selected constant rate by metering pump 20 through line 22 to metering pin 24 for application to running yarn 26.

Figure 2:
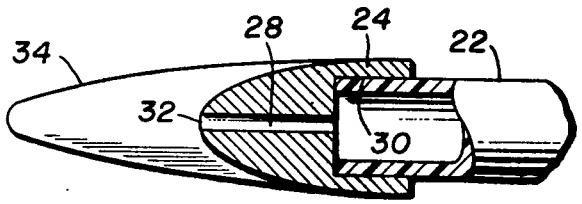
FIG. 2. (PRIOR ART)
FIG. 2 is a sectional view taken along line 2—2 in FIG. 1 showing a generalized prior art finish pin.
Figure 3:
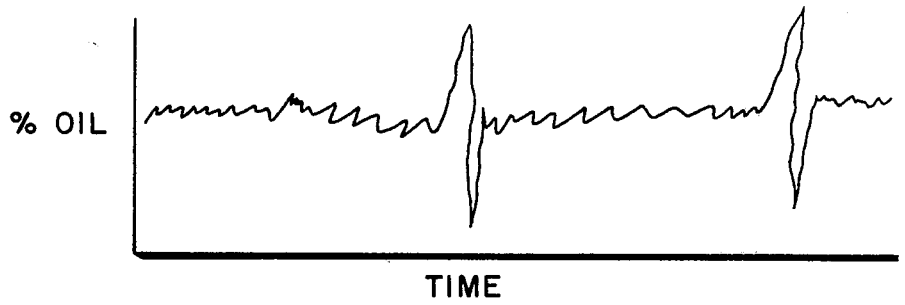
FIG. 3 is a generalized graph showing one type of observed concentration of finish applied on yarn with the FIG. 2 type of finish pin.

When finish pin 24 is constructed according to the prior art, as exemplified by FIG. 2, erratic results are frequently obtained, particularly when yarn 26 is moving at least 2500 meter per minute. In the FIG. 2 construction, a simple right circularly cylindrical fluid passageway 28 extends from the supply end 30 for receiving line 22 to its exit end 32, the latter lying at the bottom of a groove formed between two protruding fingers 34 and 36. Yarn 26 rides in the groove to receive the finish metered through passageway 28. Depending on the diameter of passageway 28, the rate at which pump 20 supplies finish, the speed of yarn 26 and the orientation of yarn 26 with respect to finish pin 24, the resulting concentration of finish on yarn 26 is frequently observed to be erratic rather than substantially constant as is desired. One such pattern is schematically shown in FIG. 3, which is a simplified or stylized representation of charts made using a denier monitoring instrument model M/7000R commercially available from Micro Sensors, Inc., together with head model 708 HC for this instrument from the same manufacturer. The output of this instrument responds not only to yarn denier but also to concentration of finish on yarn. The particular phenomena depicted in FIG. 3 is a normally reasonably constant finish level (fluctuations within a narrow range) followed first by an abrupt increase in finish level well outside the narrow range, then by a sharp decrease to an abnormally low level outside the normal range, then a return to the narrow range. A second such sequence is also shown. Other patterns of deviation from the normal narrow range may be generated, depending on the factors noted above.

It has been discovered that such undesirable deviations may be substantially reduced by interrupting siphoning at the exit of passageway 28. The entrained air is highly turbulent and apparently frequently enters exit end 32 of passageway 28, siphoning and displacing a quantity of finish before it would normally have left the passageway exit under the urging of pump 20. This would account for the observed abrupt increases in finish level (FIG. 3). Since such action would deplete the finish in exit end 32, a lower than normal quantity of finish would then be applied to yarn 26 until passageway 28 were again filled with finish by pump 20, thus accounting for the abnormally low levels of finish depicted in FIG. 3. However, regardless of the specific mechanism, inhibition of the variable influence of the entrained air upon finish in passageway 28 has been found to substantially reduce the undesired fluctuations in level of finish applied to yarn 26.

Figure 4:
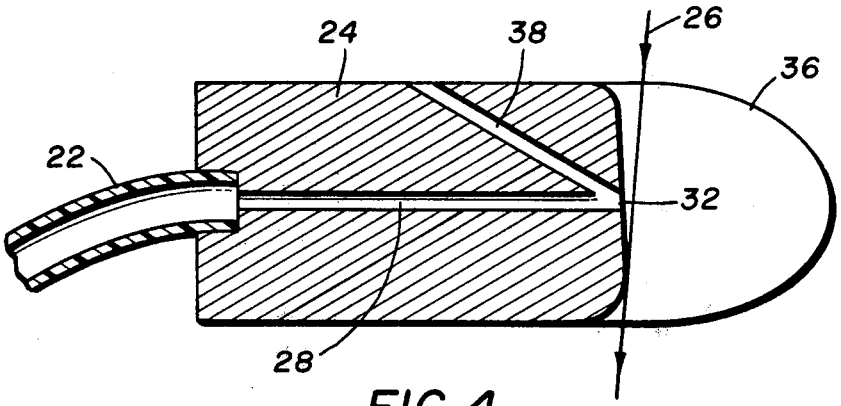
FIG. 4 is a sectional view (similar to FIG. 2) of the preferred embodiment of a finish pin according to the invention.
Figure 5:
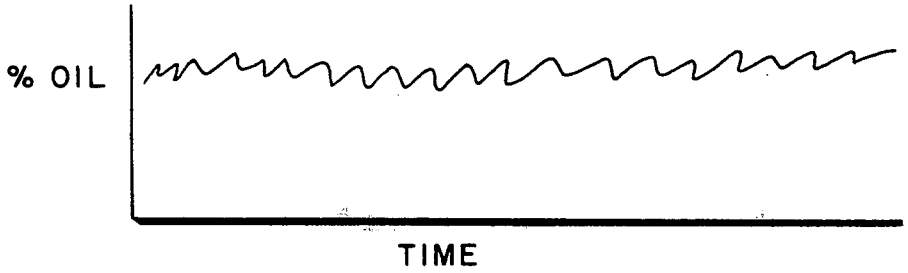
FIG. 5 is a generalized graph of concentration of finish applied on yarn with the FIG. 4 finish pin.

The preferred embodiment of the invention is shown in FIG. 4. As there illustrated, means 38 are provided for interrupting siphoning at the exit end 32 of finish passageway 28, the presently preferred means 38 being in the form of a gas passageway communicating with the atmosphere. When an abnormally low pressure is generated at exit end 32 by fluctuations in the air entrained with yarn 26, air is supplied through gas passageway 38, interrupting any siphoning action resulting from such abnormally low presure. The percentage oil or finish applied to the yarn accordingly resembles that depicted in FIG. 5 rather than that in FIG. 3.

What is claimed is:

1. In a process for applying finish to a yarn running at least 2500 meters per minute and wherein finish is metered through a passageway just prior to application to said yarn, the improvement comprising interrupting siphoning at the exit of said passageway.

2. The process defined in claim 1, wherein said interrupting is accomplished by introduction of a gas into said passageway in the immediate vicinity of said exit.

3. In a finish applicator having a finish passageway extending therethrough to an exit end, the improvement comprising means in the application for interrupting siphoning at said exit end.

4. The applicator defined in claim 3, wherein said means comprises a gas passageway in said applicator, said gas passageway communicating with said finish passageway in the immediate vicinity of said exit end.

5. The applicator defined in claim 4, wherein said gas passageway communicates with the atmosphere.

* * * * *

UNITED STATES PATENT AND TRADEMARK OFFICE

CERTIFICATE OF CORRECTION

PATENT NO. : 4,255,472

DATED : March 10, 1981

INVENTOR(S) : Louis B. Williams, Jr.

It is certified that error appears in the above–identified patent and that said Letters Patent are hereby corrected as shown below:

Column 3, line 1, "application" should read --applicator--.

Signed and Sealed this

*Twenty-first* Day of *July 1981*

[SEAL]

*Attest:*

GERALD J. MOSSINGHOFF

*Attesting Officer*

*Commissioner of Patents and Trademarks*